US007813674B2

(12) United States Patent
Kobayashi et al.

(10) Patent No.: US 7,813,674 B2
(45) Date of Patent: Oct. 12, 2010

(54) DEVELOPING TONER FOR ELECTROPHOTOGRAPHY AND ELECTRO-PHOTOGRAPHIC DEVICE

(75) Inventors: Junji Kobayashi, Ibaraki (JP); Shigenori Yaguchi, Ibaraki (JP); Tomonari Hokkyo, Ibaraki (JP); Hirobumi Ouchi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 548 days.

(21) Appl. No.: 11/024,881

(22) Filed: Dec. 30, 2004

(65) Prior Publication Data

US 2005/0158645 A1 Jul. 21, 2005

(30) Foreign Application Priority Data

Jan. 9, 2004 (JP) ..... P 2004-004642

(51) Int. Cl.
*G03G 15/20* (2006.01)
*G03G 15/04* (2006.01)

(52) U.S. Cl. ..... 399/123; 399/119

(58) Field of Classification Search ..... 399/123, 399/119; 430/123, 119
See application file for complete search history.

(56) References Cited

U.S. PATENT DOCUMENTS 6,861,194 B2 * 3/2005 Kabai ..... 430/124.33
7,022,448 B2 * 4/2006 Yaguchi et al. ..... 430/108.8
7,056,636 B2 * 6/2006 Tomita et al. ..... 430/108.4
7,095,974 B2 * 8/2006 Yoshino et al. ..... 399/359
7,189,485 B2 * 3/2007 Yamazaki et al. ..... 430/109.4
2001/0019805 A1 * 9/2001 Ohba et al. ..... 430/110.4
2004/0043317 A1 * 3/2004 Yaguchi et al. ..... 430/108.8
2004/0053153 A1 * 3/2004 Yaguchi et al. ..... 430/106.1
2004/0091296 A1 * 5/2004 Ishizuka et al. ..... 399/329
2004/0185364 A1 * 9/2004 Kanamaru et al. ..... 430/109.1

FOREIGN PATENT DOCUMENTS

JP 62-45552 9/1987
JP 3-38652 2/1991
JP 4-186367 7/1992
JP 4-362953 12/1992
JP 5-34966 2/1993
JP 7-43939 2/1995
JP 07-287413 10/1995

(Continued)

OTHER PUBLICATIONS

Diamond, Arthur S., Handbook of Imaging Materials, Nov. 2001.*

(Continued)

*Primary Examiner*—Amanda C. Walke
(74) *Attorney, Agent, or Firm*—McGinn IP Law Group, PLLC

(57) ABSTRACT

A toner for electrophotography containing at least a fixing resin, a coloring agent and a wax is a toner containing rice wax and carnauba wax as the wax constitutional component thereof. A cleaning unit employs the blade cleaning mode; and for the purposes of keeping the performance of the cleaning unit and preventing the generation of printing failure. The toner has a relationship between a charge amount X (i.e., an absolute value of charge amount of the toner, μC/g) and a deposition amount Y (mg/cm$^2$) satisfied with the following expression (1) or (2):

$$X \leqq 21 \quad (1)$$

$$X > 21 \text{ and } Y \leqq -0.0329X + 1.6223 \quad (2)$$

19 Claims, 3 Drawing Sheets

FOREIGN PATENT DOCUMENTS

| | | |
|---|---|---|
| JP | 9-244292 | 9/1997 |
| JP | 10-49021 | 2/1998 |
| JP | 11-2917 | 1/1999 |
| JP | 11-45035 | 2/1999 |
| JP | 11-295919 | 10/1999 |
| JP | 2000-155443 | 6/2000 |
| JP | 2000-242041 | 9/2000 |
| JP | 2001-272809 | 10/2001 |
| JP | 2002-251034 | 9/2002 |
| JP | 2002-278135 | 9/2002 |
| JP | 2003-207928 | 7/2003 |
| JP | 2003-280245 | 10/2003 |
| JP | 2003-330320 | 11/2003 |
| JP | 2004-246344 | 9/2004 |
| WO | 03/001302 | 1/2003 |

OTHER PUBLICATIONS

Japanese Office Action dated Mar. 25, 2008, with English translation.

* cited by examiner

FIG. 1

| | WAX 1 | WAX 2 | SAMPLE NO. | CHARGE AMOUNT (-μC/g) | DEPOSITION AMOUNT OF TONER (mg/cm²) DEVELOPMENT BIAS (-V) 400 | 500 | CLEANING PROP-ERTIES | IMAGE QUALITY | REMARK |
|---|---|---|---|---|---|---|---|---|---|
| COMPOSITION EXAMPLE 1 | CARNAUBA WAX: 1% | RICE WAX: 1.5% | 1 | 15.5 | 1.275 | | A | A | |
| | | | 2 | 19.1 | 1.075 | | A | A | |
| | | | 3 | 27.3 | 0.713 | | A | B | |
| | | | 4 | 27.3 | | 0.825 | C | C | |
| COMPOSITION EXAMPLE 2 | CARNAUBA WAX: 1.5% | RICE WAX: 1% | 5 | 18.8 | 1.163 | | A | A | |
| | | | 6 | 21.0 | 1.063 | | A | A | |
| | | | 7 | 24.2 | 0.663 | | A | A | |
| | | | 8 | 24.2 | | 0.875 | C | A | |
| COMPOSITION EXAMPLE 3 | CARNAUBA WAX: 1% | RICE WAX: 1.5% | 9 | 18.4 | 1.188 | | A | A | |
| | | | 10 | 22.3 | 0.775 | | A | A | |
| | | | 11 | 22.3 | | 0.900 | B | A | |
| COMPOSITION EXAMPLE 4 | CARNAUBA WAX: 1% | RICE WAX: 1.5% | 12 | 16.1 | 1.025 | | A | A | 0Kc |
| | | | 13 | 19.1 | 0.975 | | A | A | 30Kc |
| | | | 14 | 22.5 | 0.738 | | A | A | 86Kc |
| | | | 15 | 24.3 | 0.750 | | A | A | 120Kc |
| COMPOSITION EXAMPLE 5 | CARNAUBA WAX: 2.5% | | 16 | 11.4 | 1.000 | | A | A | LARGE IN FLYING |
| | | | 17 | 15.4 | | 1.088 | C | A | |
| | | | 18 | 18.7 | | 0.925 | C | A | |
| | | | 19 | 23.6 | | 0.750 | C | A | |
| | | | 20 | 26.4 | | 0.650 | C | C | |
| COMPOSITION EXAMPLE 6 | CARNAUBA WAX: 2.5% | | 21 | 20.9 | | 1.038 | C | A | |
| | | | 22 | 25.9 | 0.700 | | A | C | |
| | | | 23 | 28.0 | 0.650 | | A | C | |
| | | | 24 | 28.1 | | 0.675 | C | C | |
| COMPOSITION EXAMPLE 7 | FISHER-TROPSCH WAX: 0.5% | RICE WAX: 2% | 25 | 22.0 | 0.850 | | A | C | |
| | | | 26 | 23.0 | 0.840 | | A | C | |

DEVELOPING TONER FOR ELECTROPHOTOGRAPHY AND ELECTRO-PHOTOGRAPHIC DEVICE

BACKGROUND OF THE INVENTION

1. Field of the Invention

The present invention relates to a developing toner for electrophotography which visualizes an electrostatic charge latent image formed in electrophotography, electrostatic printing, electrostatic recording, etc. and to an electrophotographic device. In particular, the invention relates to an electrophotographic device for transferring a toner image on a photoreceptor onto a recording medium by a transfer unit and then cleaning the residual toner on the photosensitive element by a cleaning blade.

2. Description of the Related Art

Among the foregoing printing or recording methods, for example, in the electrophotographic method, a photoconductive photoreceptor is charged and exposed to form an electrostatic charge latent image on the photoreceptor, the electrostatic charge latent image is then developed with a finely divided toner containing a resin as a binder and a coloring agent, etc., and the resulting toner image is transferred onto recording paper and fixed thereonto to obtain a recording image.

In such electrostatic image recording steps, in order to always obtain a beautiful image quality, it is important that the residual toner in the preceding step is not carried over into the next step, and therefore, a cleaning step takes an especially important step.

So far, as a method of developing a toner, a magnetic brush development method using a two-component developer composed of a toner capable of achieving high-speed and high-image quality development and a magnetic carrier has been frequently employed. Also, as a method of cleaning the residual toner, a method of contacting and rotating a brush to undergo mechanical cleaning and a method of press contacting a blade and scraping off the residual toner to achieve cleaning have hitherto been put into practical use. Above all, the latter cleaning mode by a blade is most generally employed because it does not require a drive mechanism, etc. and is cheap.

On the other hand, in recent years, a laser beam printer using laser beams for exposing a photoconductive photosensitive element and reproducing a recording image with dots by a modulation signal due to indication of a computer is developing with the development of information instruments. In particular, in the latest laser beam printers, since the image preparation with a higher image quality is demanded, the diameter of laser beam is contracted and made small so that the dot density becomes high as 600 to 1,200 dpi (dots/inch). Following this matter, for the purpose of developing an electrostatic charge latent image which has become fine, the particle sizes of toner and carrier become small, and it is advanced to apply a small-particle size toner having a volume average particle size of not more than 10 μm and a small-particle size carrier having a weight average particle size of not more than 100 μm.

However, in the small-particle size toner, since the yield is lowered in the pulverization and classification steps at the time of toner production, costs of the toner become high. In the small-particle size toner, such a problem is caused, and in general, it is difficult to put a toner of less than 4 μm into practical use. Accordingly, a toner prepared by making the average particle size fall within the range of from 4 to 10 μm, thereby cutting off fine particles and enhancing the fluidity by improving external additives and external preparation of the toner is used.

On the other hand, with the reduction of the particle size of the toner, the carrier is made small so as to have a weight average particle size of not more than 100 μm, and the specific surface area of the carrier is increased, whereby frictional electrification properties are enhanced. However, in a carrier of less than 30 μm, a magnetic force of the carrier is lowered, and the carrier is liable to adhere onto an electrostatic charge image holding member due to an electrostatic attraction. Accordingly, a carrier prepared by classifying it into an average particle size in the range of from 30 to 100 μm and optionally coating the surface with a resin is used.

By an improvement of the particle size distribution and improvements of the fluidity and electrification, small-particle size toners and developers have become put into practical use in copying machines, printers, and so on. However, in the case of carrying out printing in an actual machine, especially in the case of repeating printing of 10 sheets or more per minute, the foregoing problems inherent to the small-particle size toners are caused, and a lowering of the life of a developer due to carrier spent by the toner and a lowering of the life of a photoreceptor due to photoreceptor filming by the toner are likely generated.

Also, the small-particle size toners have strong electrostatic adsorptivity and are liable to generate cleaning failure. Accordingly, so far, a device such as an increase of contact pressure of a blade was made. However, because of an increase of the coefficient of friction against the photoreceptor, the generation of a scratch, a lowering of the life, and the generation of stripping of the blade possibly occurred. In the case where a scratch is generated, a scoreline is generated on the image, resulting in printing failure. Also, in the case where stripping of the blade is generated, the residual toner slips through the blade and is carried over into the next step, resulting in the occurrence of printing staining. In particular, in the case where the electrostatic adsorptivity is especially strong, the toner is hardly scraped off by the blade, and therefore, the blade is more strongly pressed against the photoreceptor, thereby trying to scrape off the residual toner. Thus, the blade is more likely stripped.

In order to prevent such problems from occurring, a method of controlling the adsorptivity of the toner and a method of controlling the toner amount to be fed as a lubricant between the blade and the photoreceptor to prevent stripping of the blade from occurring have been proposed. However, for the purpose of enhancing the scraping effect, it was difficult to cope with the life. Therefore, it was necessary for bringing more softly the blade with press contact with the photoreceptor to achieve a long life, thereby preventing the occurrence of printing staining due to scraping failure of the residual toner.

Also, so far, with respect to the blade cleaning, no improvement has been made from the standpoint of toner material; no improvement has been made while turning an attention to a wax as a mold releasing agent for optimizing the adsorptivity of the toner; and an improvement has been made while mainly taking the main purpose for the thermal characteristic.

JP-A-10-49021, JP-A-11-45035, and JP-A-2000-242041 can be enumerated as such known documents.

SUMMARY OF THE INVENTION

The invention is concerned with a cleaning unit especially employing the blade cleaning mode in the foregoing developer and image preparation method, and problems that the invention is to solve are to give an appropriate charge amount at the time of development for the purpose of preventing the foregoing inconveniences from occurring and to provide a toner and an image preparation device for visualizing a latent image on a photoreceptor with an appropriate amount of a toner and always carrying out blade cleaning in the low load state.

In order to solve the foregoing problems, the present inventors made extensive and intensive investigations. As a result, it has become clear that an object of the invention can be achieved by the following construction. That is, the invention is subjective to an electrophotographic device having an electrostatic image recording process including forming an electrostatic latent image on a photoreceptor, visualizing the latent image by a development unit, transferring a toner image onto a recording medium by a transfer unit, and removing the residual toner on the photo-sensitive element by a cleaning unit, while fixing the transferred toner image on the recording medium to obtain a recording image.

According to a first aspect of the invention, a developing toner for electrophotography, includes a fixing resin; a coloring agent; and a wax containing a rice wax and a carnauba wax, in which the developing toner are satisfactory with the following equations (1) or (2):

$$X \leqq 21 \quad (1)$$

$$X > 21 \text{ and } Y \leqq -0.0329X + 1.6223 \quad (2)$$

where X is an absolute value of charge amount of the developing toner (μC/g); and Y is a deposition amount of the developing toner (mg/cm$^2$).

According to a second aspect of the invention, an electrophotographic device includes a developing toner; a photoreceptor; an optical unit forming an electrostatic latent image on the photoreceptor; a development unit visualizing the electrostatic latent image on the photoreceptor with the developing toner; a transfer unit transferring the visualized toner image onto a recording medium; a fixing unit fixing the transferred toner image on the recording medium to obtain a recording image; and a cleaning unit removing a residual toner on the photoreceptor and having a cleaning blade which comes into press contact with the photoreceptor. The developing toner are satisfactory with the following equations (1) or (2):

$$X \leqq 21 \quad (1)$$

$$X > 21 \text{ and } Y \leqq -0.0329X + 1.6223 \quad (2)$$

where X is an absolute value of charge amount of the developing toner (μC/g); and Y is a deposition amount of the developing toner (mg/cm$^2$).

The invention has the foregoing construction, and the foregoing developing toner for electrophotography and electrophotographic device are able to impart an appropriate charge amount to the toner and to carry out blade cleaning of an appropriate amount of the toner. Therefore, it is possible to design to realize a low load and a long life of the blade cleaning unit without applying a high load such that stripping (bringing the blade into contact with the photoreceptor by a high press contact force) is generated.

BRIEF DESCRIPTION OF THE DRAWINGS

FIG. 1 is a drawing to show the composition of toner for electrophotography, the charge amount of toner, the deposition amount of toner, and the evaluations of cleaning effect and image quality in each of the Example;

DETAILED DESCRIPTION OF THE PREFFERED EMBODIMENTS

An embodiment of the invention will be described below in detail. First of all, a schematic construction of the electrophotographic device according to the invention will be described below with reference to FIG. 3. The surface of a drum-shaped photoreceptor 1 is entirely charged by a charge unit 2, and an electrostatic latent image is formed on the photoreceptor 1 by an optical unit 8.

Figure 3:
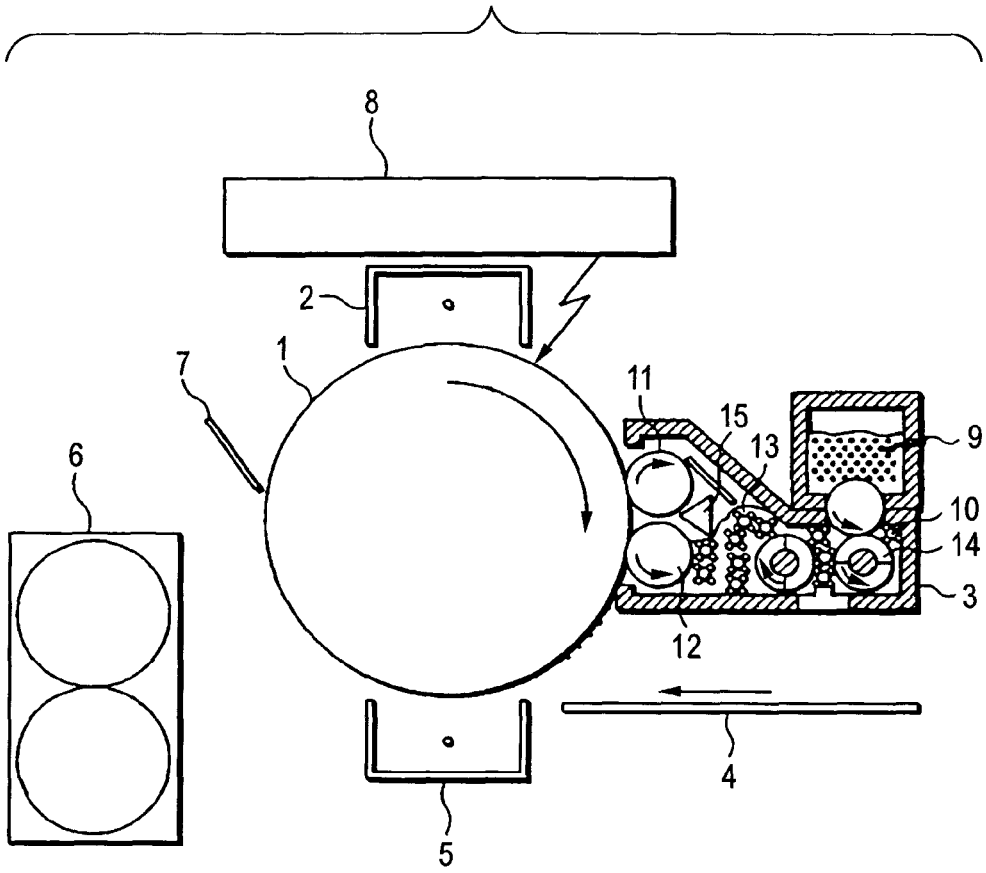
FIG. 3 is a schematic constructive view of the electrophotographic device according to an embodiment of the invention.

This electrostatic latent image is visualized by a development unit 3 to form a toner image on the photosensitive element 1. This development unit 3 is of a structure of the center feed mode in which a backward development roll 11 which rotates in the backward direction against the movement direction (rotation direction) of the photoreceptor 1 and a forward development roll 12 which rotates in the forward direction against the movement direction (rotation direction) of the photoreceptor 1 are aligned opposite to each other. Besides, the development unit 3 is provided with a two-component developer 13 comprising a toner 9 and a carrier 10 as described later, a stirring member 14, and a control member 15. Incidentally, FIG. 3 illustrates the case where one backward development roll 11 and one forward development roll 12 are provided. However, the number of rolls to be set up can be increased, if desired.

This embodiment has a series of recording processes in which the toner image on the photoreceptor 1 is transferred onto a recording medium 4 by a transfer unit 5, and the residual toner on the photoreceptor 1 is cleanly removed by a cleaning unit 7 provided with a cleaning blade, whereas the transferred toner image on the recording medium 4 is fixed by a fixing unit 6 to obtain a recording image.

The developing toner of the invention is a toner containing at least rice wax and carnauba wax as constitutional components thereof; the foregoing cleaning unit employs the blade cleaning mode; and for the purposes of keeping the performance of the cleaning unit and preventing printing failure from occurring, the toner is characterized by having a relationship between a charge amount X (i.e., an absolute value of charge amount of the toner, μC/g) and a deposition amount Y (mg/cm$^2$) satisfied with the following expression (1) or (2).

$$X \leqq 21 \quad (1)$$

$$X > 21 \text{ and } Y \leqq -0.0329X + 1.6223 \quad (2)$$

So far, waxes, especially hydrocarbon waxes such as polyethylene waxes, are likely melted sharply at low temperatures. Therefore, by containing such a hydrocarbon wax in a toner, the toner is easily melted by a low quantity of heat; the toner is penetrated into a recording medium such as paper by a low quantity of heat and solidified to reveal an anchor effect; and a strength necessary for performing peeling is liable to be obtained. Also, in recent years, it has become clear that a lowering of the life of a developer due to carrier spent by the toner, and therefore, in general, the hydrocarbon waxes are most frequently used as a wax for toner.

However, in some case, such a hydrocarbon wax is poor in compatibility with a part of resins such as polyesters and is not well dispersed at the time of kneading; and therefore, the respective toner causes non-uniformity in the charge ability to generate a non-uniform image quality (the generation of unevenness in solid images, etc.). For this reason, in the case of using a part of resins such as polyesters, carnauba wax having good compatibility is often used, whereby a high-quality image which is free from non-uniformity can be obtained.

However, among waxes, carnauba wax is a wax which is relatively poor in the mold release properties. In the case of cleaning the residual toner on a photoreceptor by the blade-mode cleaning, in order to cause no cleaning failure, it is indispensable to bring a blade into press contact with the photoreceptor relatively strongly while taking into account the hardness, contact angle and contact pressure (press contact force) of the blade, an aspect of which is contrary to the problems such as a scratch of the photoreceptor, stripping of the blade, and shortening of the life of the blade.

Now, under these circumstances, by preferentially taking into account the image quality in using a part of resins such as polyesters, waxes capable of adding mold release properties were investigated on a basis of carnauba wax having good compatibility. As a result, it has become clear that rice wax purified from rice bran has good compatibility and further has mold release properties.

In cleaning the residual toner on the photoreceptor after transfer, a cleaning unit employing the blade cleaning mode was used. However, in order to design to prolong the life of the blade, a cleaning unit which applies a low load to the photoreceptor was aimed without especially touching the hardness and press contact force of the blade. In this way, by controlling the electrostatic adsorptivity of the toner and the deposition amount of the toner, a cleaning unit which is free from leaving, slipping-through, and stripping of the blade could be realized.

The charge amount of the toner can be measured by various methods. In the invention, the charge amount of the toner was measured using a suction blow type powder charge amount measuring instrument. The charge amount of the toner was measured using TB-203 (manufactured by Kyocera Chemical Corporation) as the measuring unit. A developer sample prepared by collecting above the development magnetic roll of a developing machine, weighing in an amount of about 0.2 g on a 400-mesh metal net within a Farady gauge, and measuring for a measuring time of 3.0 seconds, at a suction pressure of 3.5 to 4.0 kPa and at a blow pressure of about 10.0 kPa was used.

The deposition amount of the toner was measured using a suction nozzle of a suction type small-sized charge amount measuring instrument (210HS, manufactured by Trek). In a sample, the toner image is transferred onto a recording medium by urgently stopping a printer in the printing state and made in the unfixed state. An image pattern to be sucked by the suction nozzle was formed into a solid image having a size of 2 cm square, and the deposition amount of the toner per unit area ($cm^2$) was determined from the measured value.

The polarity of the toner as reviewed in the invention is minus and will be hereunder described in terms of an absolute value. But, it should not be construed that the polarity is limited to a minus polarity. The charge amount of the toner is suitably not more than $|-21|$ μC/g so far as image quality characteristics such as image density, image uniformity, and fog are allowable. In the case where the charge amount of the toner exceeds $|-21|$ μC/g, it is suitable that the relationship of $Y \leqq -0.0329X+1.6223$ (wherein Y represents a deposition amount of the toner ($mg/cm^2$), and X represents an absolute value of a charge amount of the toner) is satisfied.

The particle size of the toner can be measured by various methods. In the invention, the particle size of the toner was measured using a Coulter counter. Using an aperture of 100 μm and a Coulter counter TA-II model (manufactured by Coulter), the number distribution and volume distribution were measured. At this time, 50,000 particles prepared by adding a toner to be measured in an electrolytic liquid having a surfactant added thereto and dispersing for one minute by an ultrasonic dispersing machine were measured as a sample for measurement.

The toner preferably has an average particle size of from 4 to 10 μm, and a proportion of particles of not more than 4 μm to be contained in the toner is preferably controlled at not more than 25% by number of the whole of toner particles. Further, by controlling the proportion of particles of not more than 4 μm at not more than 15% by number of the whole of toner particles, the durability is further enhanced.

In the two-component developer, the carrier is mixed with several % of the toner, thereby charging the toner due to friction between the toner and the carrier. The toner of not more than 4 μm is hardly separated from the carrier and comes into contact with the carrier over a long period of time, and therefore, spent is likely caused on the carrier surface. Also, the finely divided toner of not more than 4 μm requires a lot of heat energy at the time of deposition (fog) of the toner onto a non-image area and fixing as compared with toners having a large particle size and is disadvantageous in low-temperature fixing properties. Accordingly, the proportion of particles of not more than 4 μm is suitably not more than 25% by number, preferably not more than 15% by number, and more preferably not more than 10% by number of the whole of toner particles.

In addition to the foregoing polyester resin, specific examples of the fixing resin which is used in the toner of the invention include the following resins.

That is, examples include homopolymers of styrene or substitution products thereof (for example, polystyrene, poly-α-chlorostyrene, and polyvinyltoluene); and styrene based copolymers (for example, a styrene-p-chlorostyrene copolymer, a styrene-vinyltoluene copolymer, a styrene-vinylnaphthalene copolymer, a styrene-acrylic ester copolymer, a styrene-methacrylic ester copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, and a styrene-acrylonitrile-indene copolymer). Examples further include polyvinyl chloride, phenol resins, natural modified phenol resins, natural resin modified maleic acid resins, acrylic resins, methacrylic resins, polyvinyl acetate, silicone resins, polyurethanes, polyamide resins, furan resins, epoxy resins, xylene resin, polyvinyl butyral, terpene resins, chroman-indene resins, and petroleum resins. Of these, polyester resins and styrene based resins are preferable. Also, lowly hygroscopic resins prepared by graft copolymerizing styrene-acryl on the foregoing polyester resin can be used.

Incidentally, the styrene based polymers or styrene based copolymers may be one having been crosslinked or a mixed resin. For the purpose of fixing at low temperatures and preventing high-temperature offset, for example, in the case of styrene-(meth)acrylate resins, the resins are composed of a high molecular weight polymer and a low molecular weight polymer, and the former is effective for ensuring the offset resistance of the toner, whereas the latter is effective for ensuring a fixing strength.

Also, in order to enhance the compatibility between the fixing resin and the wax, a coexistence polymerization method in which the wax is made coexistent entirely or partially in the step for synthesizing the fixing resin may be employed.

In the method of preparing the fixing resin in the presence of the wax by the coexistence polymerization method, the vinyl based copolymer can include a styrene based monomer and/or a (meth)acrylic ester monomer and other vinyl based monomer as constitutional components thereof.

In the invention, by carrying out the coexistent polymerization in the presence of the wax entirely or partially in the step of the synthesis, it is possible to obtain at least a vinyl based copolymer having the wax uniformly dispersed therein as a constitutional element thereof. Incidentally, the vinyl based copolymer may be partly crosslinked with a crosslinking agent such as monomers mainly containing two or more polymerizable double bonds (for example, divinylbenzene, divinylnaphthalene, ethylene glycol dimethacrylate, 1,3-butanediol dimethacrylate, divinyl-aniline, divinyl ether, divinyl sulfide, and divinyl sulfone).

In addition to styrene, specific examples of the styrene monomer which is a constitutional unit of the vinyl polymer include o-methylstyrene, m-methylstyrene, α-methylstyrene, and 2,4-dimethylstyrene.

Specific examples of the acrylic ester or methacrylic ester based monomer which is a constitutional unit of the vinyl polymer include alkyl esters of acrylic acid or methacrylic acid (for example, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, and stearyl meth-acrylate), 2-chloroethyl acrylate, phenyl acrylate, methyl α-chloroacrylate, phenyl methacrylate, dimethylaminoethyl methacrylate, diethylaminoethyl methacrylate, 2-hydroxy-ethyl methacrylate, glycidyl methacrylate, bisglycidyl meth-acrylate, polyethylene glycol dimethacrylate, and methacryl-oxy phosphate. Of these, ethyl acrylate, propyl acrylate, butyl acrylate, methyl methacrylate, ethyl methacrylate, propyl methacrylate, and butyl methacrylate are especially preferable.

Examples of other vinyl based monomer which is a constitutional unit of the vinyl polymer include acrylic acids and α- or β-alkyl derivatives thereof (for example, acrylic acid, methacrylic acid, α-ethylacrylatic acid, and crotonic acid), unsaturated dicarboxylic acids or monoester derivatives or diester derivatives thereof (for example, fumaric acid, maleic acid, citraconic acid, and itaconic acid), monoacryloyloxyethyl succinate, monomethacryloyloxyethyl succinate, acrylonitrile, methacrylonitrile, and acrylamide.

In the toner of the invention, by compounding (internally adding) or mixing (externally adding) the toner particles with a charge control agent, it is possible to control the charge amount of the toner at a desired value.

Examples of a positive charge control agent of the toner include nigrosine and modification products thereof with a fatty acid metal salt; quaternary ammonium salts (for example, tributylbenzylammonium-1-hydroxy-4-naphthosulfonic acid and tetrabutylammonium tetrafluoroborate) and onium salts as analogues thereof (for example, phosphonium salts) and lake dyes thereof, triphenylmethane dyes and lake pigments thereof, and higher fatty acid metal salts; diorganotin oxides (for example, dibutyltin oxide, dioctyltin oxide, and dicyclohexyltin oxide); and diorganotin borates (for example, dibutyltin borate, dioctyltin borate, and dicyclohexyltin borate). These compounds can be used singly or in combinations of two or more thereof. Of these, charge control agents such as nigrosine based compounds, quaternary ammonium salts, and triphenylmethane dyes are preferable.

As a negative charge control agent of the toner, organometal complexes and chelate compounds are effective, and examples thereof include monoazo metal complexes, acetylacetone metal complexes, aromatic hydroxycarboxylic acid based metal complexes, and aromatic dicarboxylic acid based metal complexes. Besides, examples include aromatic hydroxycarboxylic acids, aromatic mono- or polycarboxylic acids and metal salts thereof, anhydrides, esters, and phenol derivatives such as bisphenols.

In the case of internally adding such a charge control agent in the toner, it is preferably added in an amount of from 0.1 to 10% by weight based on the fixing resin.

In the toner of the invention, for the purpose of enhancing the developability, fluidity, charge stability, and durability, it is preferred to externally add a silica fine powder, etc.

As the silica fine powder, etc. to be used in the invention, one having a specific surface area of 30 $m^2/g$ or more as measured by the BET method by nitrogen adsorption is preferable. The silica fine powder, etc. is externally added in an amount in the range of from 0.01 to 5% by weight based on the toner. Also, if desired, the silica fine powder is used after making it hydrophobic with a treating agent (for example, various organosilicon compounds) or a variety of treating agents or controlling the charge properties. Since the fluidity, durability and storage stability vary depending upon the kind of the treating agent and the particle size of the silica fine powder, the treating agent is chosen according to the purpose.

Further, it is preferred to use a lubricant powder (for example, fluorine based resin powders such as polytetrafluoroethylene, a zinc stearate powder, and a polyvinylidene fluoride powder, with the polyvinylidene powder being preferable); a polishing agent (for example, a cerium oxide powder, a silicon carbide powder, and a strontium titanate powder, with the strontium titanate powder being preferable); or a fluidity imparting agent (for example, a titanium oxide powder and an aluminum oxide powder; of these, hydrophobic ones are especially preferable). Also, it is possible to add a small amount of an anticoagulant, a conductivity imparting agent (for example a carbon black powder, a zinc oxide powder, an antimony oxide powder, and a tin oxide powder), or a developability enhancing agent (for example, white fine particles and black fine particles having reverse polarity).

The toner of the invention can contain a magnetic material, and the magnetic material can also play a role as a coloring agent. In the invention, examples of the magnetic material to be contained in the toner include iron oxide (for example, magnetite, hematite, and ferrite); and metals (for example, iron, cobalt, and nickel) or alloys thereof with a metal (for example, aluminum, cobalt, copper, lead, magnesium, tin, zinc, antimony, calcium, manganese, selenium, titanium, tungsten, and vanadium) or mixtures thereof.

The average particle size of the magnetic material is suitably not more than 2 μm, and preferably from approximately 0.1 to 0.5 μm; and the content of the magnetic material in the toner is suitably from 0.1 to 200% by weight based on the fixing resin.

Examples of the coloring agent which can be used in the toner of the invention include arbitrary proper pigments or dyes. Examples of pigments as the coloring agent of the toner include carbon black, aniline black, acetylene black, naphthol yellow, hansa yellow, rhodamine lake, arizarine lake, red iron oxide, phthalocyanine blue, and indanthrene blue. Such a pigment as the coloring agent is used in an amount necessary and sufficient for keeping the optical density of the fixed image and is preferably added in an amount of from 0.2 to 15% by weight based on the resin.

Further, dyes are used for the same purpose. Examples thereof include azo based dyes, anthraquinone based dyes, xanthene based dyes, and methine based dyes. The dye is added in an amount of from 0.2 to 15% by weight based on the resin.

In preparing the toner for electrophotography of the invention, carnauba wax and rice wax are blended in a mixing ratio of from 1/10 to 10/1; and the mixture is combined with a fixing resin, a charge control agent, a pigment or dye as a coloring agent, and a magnetic powder, and optionally, a fixing resin having an additive and a wax uniformly dispersed therein and thoroughly mixed in a mixer such as a Henschel mixer and a super mixer. Thereafter, the resulting mixture is melt kneaded using a hot melt kneader such as a heat roll, a kneader, and an extruder, thereby thoroughly mixing the raw materials. The mixture is then cooled for solidification, pulverized, and classified to obtain a toner.

Examples of the pulverization method at this time include a jet mill mode in which the toner is included in a high-speed air stream and collided against a collision plate, thereby pulverizing the toner by its energy; an inter-particle collision mode in which the toner particles are collided each other in an air stream; and a mechanical pulverization method in which the toner is fed into a narrow gap between rotors rotating at a high speed and pulverized.

According to the jet mill mode or inter-particle mode, since the toner is pulverized by collision energy, the shape of the toner particle is relatively pointed. In the case of the mechanical pulverization method, the toner is pulverized while being rubbed in the gap, and the toner surface is likely made spherical by frictional heat generated at this time. In particular, in the toner for the purpose of realization of a small particle size and low-temperature fixation, as pointed out in JP-A-7-287413, a phenomenon in which the toner is melted on the collision plate at the time of pulverization does not take place, and a lowering of the toner fluidity which is an inherent phenomenon caused when a small-particle size and low molecular weight wax is contained can be prevented. Accordingly, it is preferable that the mechanical pulverization method is employed for the pulverization.

Also, the toner can be obtained by a so-called polymerization method in which a monomer is polymerized in the presence of a coloring agent, a charge control agent, a wax, and so on to form a polymer. Further, a micro-capsulation method is employable.

In the thus prepared toner, if desired, a desired additive is adhered to and mixed with the toner using a mixer such as a Henschel mixer, whereby a toner having an additive externally added thereto can be obtained.

As the carrier to be used in the invention, ones which are known can be used. For example, a resin carrier in which an iron powder, ferrite, magnetite, glass beads, or magnetic fine particles are dispersion in a binder resin can be used, and a coating layer can be provided on the carrier surface. The charge characteristic, electrical resistance value, and the like of the carrier can be controlled by the binder resin, charge type fine particles, and coating layer.

Examples of the binder resin which can be used for the resin carrier include thermoplastic resins such as vinyl based resins, polyester based resins, polyamide based resins, and polyolefin based resins; and thermosetting resin such as phenol resins.

Examples of the magnetic fine particles which can be used include magnetite, spinel ferrites such as γ-iron oxide, spinel ferrites containing one or two or more kinds of metals other than iron (for example, Mn, Ni, Zn, Mg, and Cu), magnetoplumbite type ferrites such as barium ferrite, and particles of iron or alloys having an oxide layer on the surface thereof. The shape may be any of granular, spherical or acicular form. In particular, in the case where high magnetization is required, it is preferred to use ferromagnetic fine particles such as iron. Also, when chemical stability is taken into consideration, magnetite, spinel ferrites including γ-iron oxide, and magnetoplumbite type ferrites such as barium ferrite are preferably used. By choosing the kind and content of the ferromagnetic fine particles, it is possible to obtain a resin carrier having desired magnetization. As this time, with respect to the magnetic characteristic of the carrier, the magnetization strength at 1,000 oersteds is preferably from 30 to 150 emu/g.

Such a resin carrier is produced by spraying a melt kneaded mixture of the magnetic fine particles and the insulating binder resin using a spray dryer; or reacting and curing a monomer or a prepolymer in an aqueous medium in the presence of the magnetic fine particles, thereby dispersing the magnetic fine particles in a condensation type binder.

It is possible to control the charge properties by fixing positive or negative charge type fine particles or conductive fine particles on the carrier surface or coating with a resin.

As a coating material of the surface, silicone resins, acrylic resins, epoxy resins, fluorine based resins, and so on are used. Further, it is possible to carry out coating while containing positive or negative charge type fine particles or conductive fine particles.

The mixing ratio of the toner of the invention to the carrier is preferably from 2 to 10% by weight in terms of toner concentration.

In the electrostatic recording step including visualizing an electrostatic charge latent image formed on an electrostatic charge holding member using the toner for electrophotography of the invention, transferring the visualized toner image onto a recording medium, cleaning the residual toner image on the electrostatic charge holding member, and fixing the transferred toner image onto the recording medium to obtain a recording image, the invention is especially concerned with cleaning of the residual toner on the photoreceptor, thereby designing to prolong the life of a blade. Accordingly, the invention is able to realize a blade cleaning unit which controls an electrostatic adsorptivity of the toner and the deposition amount of the toner and is free from leaving, slipping-through, and stripping of the blade and to provide a stable preparation method of an electrostatic toner image.

The development unit which is used in the invention is chosen by the movement speed of the electrostatic charge holding member. In the case of a high-speed printer having a high movement speed of the electrostatic charge holding member, the development by a single development magnetic roll is not always sufficient, and in some case, the development is carried out using plural development magnetic rolls, increasing the development region and prolonging the development time. In the case of using plural development magnetic rolls, a high developing capacity is obtained as compared with the case of the single-development roll mode. Therefore, not only it is possible to correspond to high-area image printing and to enhance the printing quality, but also it is possible to reduce the toner content in the developer. Additionally, it is possible to prevent flying of the toner and carrier spent of the toner due to a reduction of the load to the developer from occurring, whereby the life of the developer can be further prolonged.

Moreover, in the development mode using plural development rolls, though unidirectional development in which the development rolls rotate in the forward direction against the traveling direction of the electrostatic charge holding member has a high developing capacity, background fog is likely generated, and a defect of the front end of the image or a brush mark of a magnetic brush is likely generated.

On the other hand, in unidirectional development in which the development rolls rotate in the backward direction against the traveling direction of the electrostatic charge holding member, though a defect of the rear end of the image area is observed, background fog is scarcely generated and a brush mark of a magnetic brush is hardly generated so that a stable image is obtained. However, according to the foregoing backward development, since the effective amount of the toner which comes into contact with the electrostatic charge holding member is low, the developing capacity may possibly be low. On the other hand, since the center feed mode includes both of the foregoing forward and backward development rolls, it can avoid the drawbacks in the foregoing both development modes. The development unit of the center feed mode is known by, for example, JP-B-62-45552.

According to such development mode and control of the charge amount and deposition amount of the toner for electrophotography of the invention, it is possible to stably provide a cleaning unit which is excellent in the image quality and low in the load against the photoreceptor.

Examples and Comparative Examples of the invention will be described below, but it should not be construed that the invention is limited thereto.

COMPOSITION EXAMPLE 1

| | |
|---|---|
| Polyester resin 1 (weight average molecular weight MW: 5,700, number average molecular weight Mn: 2,800, acid value: 8.6 mg-KOH/g): | 44.3 wt % |
| Polyester resin 2 (Mw: 118,900, Mn: 4,900, acid value: 3.76 mg-KOH/g): | 45.5 wt % |
| Holobispotassium salt (charge control agent: 1,1,-diphenyl-1-acetyl potassium salt): | 0.7 wt % |
| C.I. Pigment Red 184: | 2.5 wt % |
| C.I. Pigment Yellow 180: | 4.5 wt % |
| Carnauba wax (a trade name: Purified Carnauba Wax No. 1, manufactured by Cerarica Noda Co., Ltd.): | 1.0 wt % |
| Rice wax (a trade name: Rice Wax M-90, manufactured by Cerarica Noda Co., Ltd.): | 1.5 wt % |

The raw materials having the foregoing formulation were preliminarily mixed, hot melt kneaded by a twin-screw kneader, cooled, and then pulverized. The resulting mixture was classified by a dry air classifier to obtain particles having an average particle size of 9.5 μm.

Further, 0.8% by weight of hydrophobic silica (a trade name: Aerosil R972, manufactured by Nippon Aerosil Co., Ltd.) was added to the particles, and the mixture was stirred in a Henschel mixer to adhere the hydrophobic silica onto the surface of the particle. There was thus obtained a toner for Composition Example 1. Incidentally, at this time, the toner had an average particle size of 9.5 μm, and the proportion of the toner of not more than 4 μm was 6.5% by number.

The foregoing toner was mixed with a carrier prepared by changing the rate of a surface coating agent and adjusting such that the charge amount became relatively high in a mixing ratio of 4.5 to 5.0% by weight, thereby preparing four kinds of developing toners having varied charge amount of toner and deposition amount of toner as shown in FIG. 1 (Sample Nos. 1 to 4). These developing toners were subjected to printing test, and the results of evaluation are shown in the column of Composition Example 1 of FIG. 1. In the evaluation column, a symbol "A" means "good"; a symbol "B" means "slightly good"; and a symbol "C" means "poor".

With respect to the printing conditions, in a laser beam printer of the electrophotographic mode using OPC as a photoreceptor, the image preparation was carried out at a charge potential of OPC of −550 V (−650 V at the time when a development bias potential was −500 V), a residual potential of −50 V, a development bias potential of −400 V or −500 V and a contrast potential of developing area of 150 V and at a printing rate of 92 sheets per minute (printing process rate: 41.3 cm/sec).

As the developing machine, a developing machine of the center feed mode as illustrated in FIG. 3, which is provided with magnetic rolls for development which rotate in the forward direction against the traveling direction of an electrostatic charge holding member and magnetic rolls for development which rotate in the backward direction against the traveling direction of the electrostatic charge holding member, was used, a development gap (a distance between the photosensitive element and the development roll sleeve) was set up at 0.5 mm, and the image was prepared by reversal development. The cleaning was carried out by a method of bringing a polyurethane-made cleaning blade into contact with the photoreceptor in the counter-wise manner against the movement direction.

As is clear from the evaluation results of FIG. 1, cleaning failure is generated in the case where the charge amount is increased as in Sample No. 4 (>|−19.1| μC/g). It can be noted that in the case where the charge amount is low as in Sample Nos. 1 and 2, or in the case where the development bias is kept low (not more than 400 V in this example), thereby suppressing an increase of the deposition amount of the toner as in Sample No. 3, a good image quality which is free from cleaning failure can be obtained. On the other hand, when the charge amount of the toner exceeds |−27| μC/g and the deposition amount of the toner is increased as in Sample No. 4, a rough feeling starts to be revealed.

COMPOSITION EXAMPLE 2

| | |
|---|---|
| Polyester resin 1 (weight average molecular weight Mw: 5,700, number average molecular weight Mn: 2,800, acid value: 8.6 mg-KOH/g): | 44.3 wt % |
| Polyester resin 2 (Mw: 118,900, Mn: 4,900, acid value: 3.76 mg-KOH/g): | 52.2 wt % |
| Holobispotassium salt (charge control agent: 1,1,-diphenyl-1-acetyl potassium salt): | 0.7 wt % |
| C.I. Pigment Red 184: | 2.5 wt % |
| C.I. Pigment Yellow 180: | 4.5 wt % |
| Carnauba wax (a trade name: Purified Carnauba Wax No. 1, manufactured by Cerarica Noda Co., Ltd.): | 1.5 wt % |
| Ricewax (a trade name: Rice Wax M-90, manufactured by Cerarica Noda Co., Ltd.): | 1.0 wt % |

Using the raw materials having the foregoing formulation, the same procedures until the external addition step as in Composition Example 1 were followed to obtain a toner for Composition Example 2. Incidentally, at this time, the toner had an average particle size of 9.6 μm, and the proportion of the toner of not more than 4 μm was 5.3% by number.

The foregoing toner was mixed with a carrier prepared by changing the rate of a surface coating agent and sintering temperature and adjusting such that the charge amount was low level as compared with that in Composition Example 1 and stably changed in a mixing ratio at 4.5 to 5.0% by weight, thereby preparing developing toners of Sample Nos. 5 to 8. The developing toners were subjected to printing test in the same manner as in Composition Example 1, and the results of evaluation are shown in the column of Composition Example 2 of FIG. 1.

As is clear from the results, it can be noted that the matter that the charge amount of the toner is made low (<|−24.2 | μC/g) and that the development bias is kept low (not more than 400 V in this example), thereby suppressing an increase of the deposition amount of the toner as in Sample Nos. 5 to 7 is indispensable for the purpose of keeping a good image quality which is free from cleaning failure.

COMPOSITION EXAMPLE 3

| | |
|---|---|
| Polyester resin 1 (weight average molecular weight Mw: 5,700, number average molecular weight Mn: 2,800, acid value: 8.6 mg-KOH/g) | 34.4 wt % |
| Polyester resin 2 (Mw: 118,900, Mn: 4,900, acid value: 3.76 mg-KOH/g): | 55.5 wt % |
| Holobispotassium salt (charge control agent: 1,1,-diphenyl-1-acetyl potassium salt): | 0.6 wt % |
| C.I. Pigment Red 184: | 2.5 wt % |
| C.I. Pigment yellow 180: | 4.5 wt % |
| Carnauba wax (a trade name: Purified Carnauba Wax No. 1, manufactured by Cerarica Noda Co., Ltd.): | 1.0 wt % |
| Rice wax (a trade name: Rice Wax M-90, manufactured by Cerarica Noda Co., Ltd.): | 1.5 wt % |

Using the raw materials having the foregoing formulation, the same procedures until the external addition step as in Composition Example 1 were followed to obtain developing toners of Sample Nos. 9 to 11. Incidentally, at this time, the toner had an average particle size of 9.7 μm, and the proportion of the toner of not more than 4 μm was 5.2% by number.

The foregoing toner was mixed with a carrier prepared by further changing the sintering temperature as compared with the carrier used in Composition Example 2 and adjusting such that the charge amount stably changed as compared with the carrier used in Composition Example 2 in a mixing ratio (toner concentration) of 4.5 to 5.0% by weight. The developing toners were subjected to printing test under the same printing conditions as in Composition Example 1, and the results obtained are shown in the column of Composition Example 3 of FIG. 1.

As is clear from the results, by suppressing the charge amount of the toner at a low level, keeping the development bias low (not more than 400 V in this example) and suppressing an increase of the deposition amount of the toner, it is possible to obtain good results in both the cleaning properties and the image quality.

COMPOSITION EXAMPLE 4

Composition Example 4 was prepared in view of the foregoing Composition Examples 1 to 3 and evaluated according to the following construction. As a result, it was confirmed that cleaning failure did not occur until 120 K-cycle printing, whereby a good image quality could be kept.

That is, the same toner prepared in Composition Example 3 was used as the developing toner, and a carrier prepared by further changing the sintering temperature to suppress the deposition amount of toner was used. The mixing ratio (toner concentration) was adjusted at 4.5 to 5.0% by weight, thereby preparing developing toners of Sample Nos. 12 to 15. The developing toners were subjected to printing test.

The results obtained are shown in the column of Composition Example 4 of FIG. 1. As is clear from the results, the charge amount and deposition amount of the toner were controlled until 120 Kc, images which are free from cleaning failure and have a good image quality could be obtained.

Figure 2:
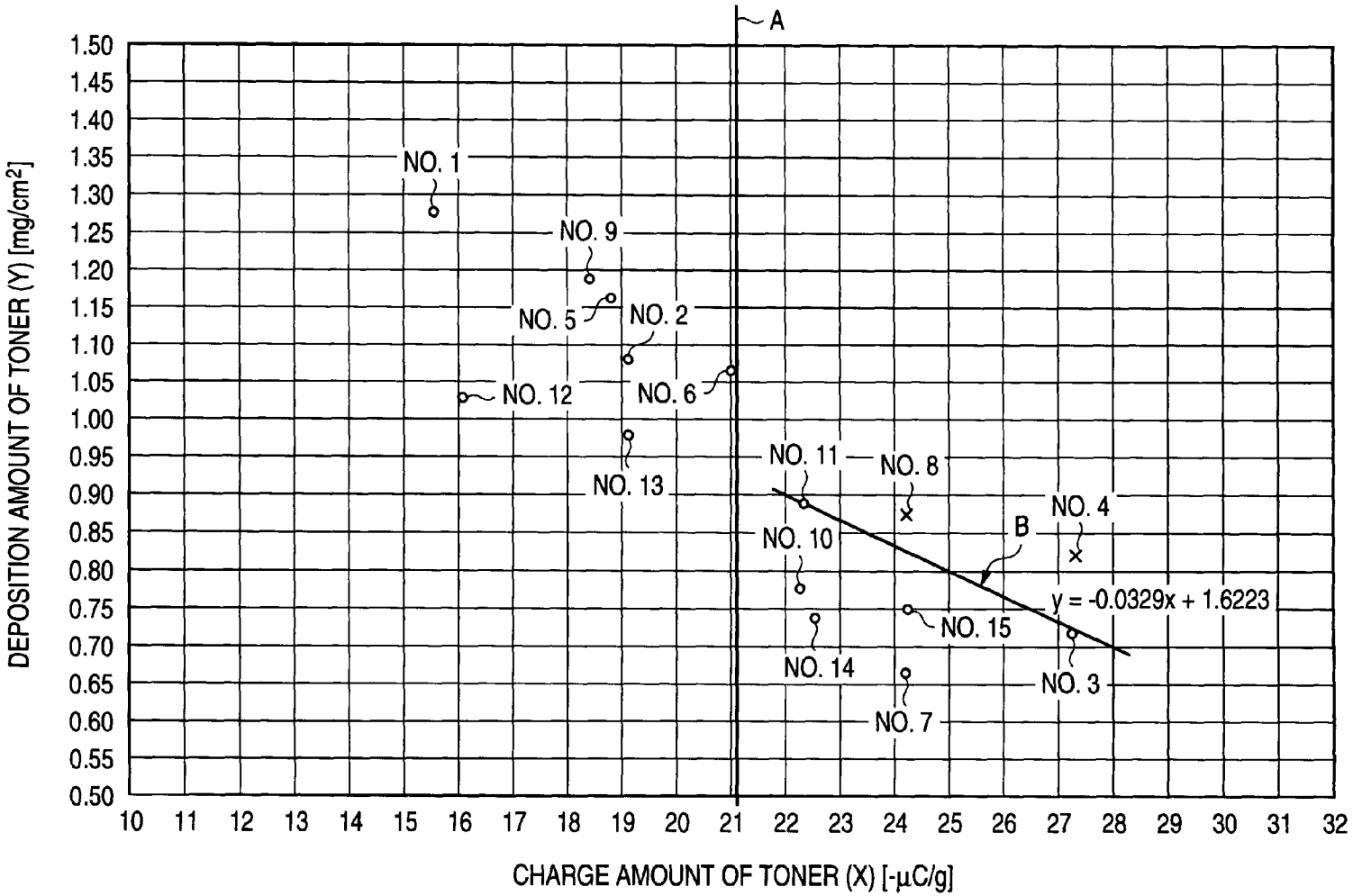
FIG. 2 is a drawing plotting the relationship between the charge amount of toner and the deposition amount of toner in the case of using a mixture of carnauba wax and rice wax as the wax constitutional component.

With respect to the foregoing Composition Examples 1 to 4 (Sample Nos. 1 to 15) using a mixture of carnauba wax and rice wax as the wax component of the developer, a relationship between the charge amount (X) and the deposition amount (Y) of the toner were plotted on FIG. 2.

As is clear from FIGS. 1 and 2, the samples located in the left-side region against the straight line A in FIG. 2, namely, the samples having an absolute value of the charge amount X of toner of not more than 21 μC/g ($X \leqq 21$, Sample Nos. 1, 2, 5, 9, 12 and 13), are good in both the cleaning properties and the image quality.

Also, the samples having an absolute value of the charge amount X of toner of more than 21 μC/g ($X > 21$ μC/g) and located under the straight line B in FIG. 2, namely the samples having the deposition amount of toner of $Y \leqq -0.0329X + 1.6223$ (Sample Nos. 3, 7, 10, 11, 14 and 15), are good in both the cleaning properties and the image quality.

COMPOSITION EXAMPLE 5

| | |
|---|---|
| Polyester resin 1 (weight average molecular weight Mw: 5,700, number average molecular weight Mn: 2,800, acid value: 8.6 mg-KOH/g): | 36.1 wt % |
| Polyester resin 2 (Mw: 118,900, Mn: 4,900, acid value: 3.76 mg-KOH/g): | 54.0 wt % |
| Holobispotassium salt (charge control agent: 1,1,-diphenyl-1-acetyl potassium salt): | 0.4 wt % |
| C.I. Pigment Red 184: | 2.5 wt % |
| C.I. Pigment Yellow 180: | 4.5 wt % |
| Carnauba wax (a trade name: Purified Carnauba Wax No. 1, manufactured by Cerarica Noda Co., Ltd.): | 2.5 wt % |

Using the raw materials having the foregoing formulation, the same procedures until the external addition step as in Composition Example 1 were followed to obtain developing toners of Sample Nos. 16 to 20 for Composition Example 5. Incidentally, at this time, the toner had an average particle size of 8.9 μm, and the proportion of the toner of not more than 4 μm was 11.1% by number.

The foregoing toner was mixed with the carrier used in Composition Example 2 in a mixing ratio (toner concentration) of 4.5 to 5.0% by weight. The developing toners were subjected to printing test under the same printing conditions as in Composition Example 1, and the results obtained are shown in the column of Composition Example 5 of FIG. 1.

As is clear from the results, Sample No. 16 is good in both the cleaning properties and the image quality but large in flying of the toner. Also, in Sample Nos. 17 and 18, even when the charge amount is not more than |−21.0| μC/g, cleaning failure is generated. Further, in the side of high charge amount (|−26.4| μC/g ) as in Sample No. 19, the image is increased in a rough feeling so that it does not lie in a practically useful level.

COMPOSITION EXAMPLE 6

| | |
|---|---|
| Polyester resin 1 (weight average molecular weight Mw: 5,700, number average molecular weight Mn: 2,800, acid value: 8.6 mg-KOH/g): | 30.7 wt % |
| Polyester resin 2 (Mw: 118,900, Mn: 4,900, acid value: 3.76 mg-KOH/g): | 62.4 wt % |
| Holobispotassium salt (charge control agent: 1,1,-diphenyl-1-acetyl potassium salt): | 0.4 wt % |
| C.I. Pigment Blue 15:3: | 4 wt % |
| Carnauba wax (a trade name: Purified Carnauba Wax No. 1, manufactured by Cerarica Noda Co., Ltd.): | 2.5 wt % |

Using the raw materials having the foregoing formulation, the same procedures until the external addition step as in Composition Example 1 were followed to obtain developing toners of Sample Nos. 21 to 24 for Composition Example 6. Incidentally, at this time, the toner had an average particle size of 9.1 μm, and the proportion of the toner of not more than 4 μm was 9.6% by number.

The foregoing toner was mixed with the carrier used in Composition Example 2 in a mixing ratio (toner concentration) of 4.5 to 5.0% by weight. The developing toners were subjected to printing test, and the results obtained are shown in the column of Composition Example 6 of FIG. 1.

Likewise Composition Example 5, even when the charge amount is not more than |−21.0| μC/g as in Sample No. 21, cleaning failure is generated. Also, in a region where the charge amount is |−25| μC/g or more as in Sample Nos. 22 to 24, the image is increased in a rough feeling so that it does not lie in a practically useful level.

COMPOSITION EXAMPLE 7

| | |
|---|---|
| Polyester resin 1 (weight average molecular weight Mw: 5,700, number average molecular weight Mn: 2,800, acid value: 8.6 mg-KOH/g): | 44.3 wt % |
| Polyester resin 2 (Mw: 118,900, Mn: 4,900, acid value: 3.76 mg-KOH/g): | 45.6 wt % |
| Holobispotassium salt (charge control agent: 1,1,-diphenyl-1-acetyl potassium salt): | 0.6 wt % |
| C.I. Pigment Red 184: | 2.5 wt % |
| C.I. Pigment Yellow 180: | 4.5 wt % |
| Fisher-Tropsch wax: | 0.5 wt % |

Using the raw materials having the foregoing formulation, the same procedures until the external addition step as in Composition Example 1 were followed to obtain developing toners of Sample Nos. 25 and 26 for Composition Example 7. Incidentally, at this time, the toner had an average particle size of 9.5 μm. and the proportion of the toner of not more than 4 μm was 9.1% by number.

The foregoing toner was mixed with the carrier used in Composition Example 2 in a mixing ratio (toner concentration) of 4.5 to 5.0% by weight. The developing toners were subjected to printing test, and the results obtained are shown in the column of Composition Example 7 of FIG. 1.

The Fisher-Tropsch wax is a linear hydrocarbon based wax made of coal as the raw material and obtained by catalytic hydrogenation with carbon monoxide, which is low in the iso-structure molecule and side change. This wax is poor in compatibility with resins. For this reason, spot-like unevenness is formed on the image, and the image quality is poor so that it does not lie in a practically useful level.

As the rice wax which is used in the invention, one having an acid value of not more than 13 (mg-KOH/g), a melting point of from 78 to 82° C., and a penetration at 25° C. of 5, specifically Rice Wax M-90 (a trade name manufactured by Cerarica Noda Co., Ltd.) which is used in the foregoing Composition Examples 1 to 4 is especially suitable. Also, as the carnauba wax, one having an acid value of not more than 10 (mg-KOH/g), a melting point of from 80 to 86° C., and a penetration at 25° C. of not more than 1, specifically Purified Carnauba Wax No. 1 (a trade name manufactured by Cerarica Noda Co., Ltd.) which is used in the foregoing Composition Examples 1 to 4 is especially suitable.

Since the toner for electrophotography according to the invention is improved such that it is suitable for blade cleaning from the material standpoint, it can be applied to any electrophotographic device regardless of the material quality and installing condition of a blade, and the like.

What is claimed is:

1. An electrophotographic device comprising:

a developing toner, comprising a rice wax and a carnauba wax;

a photoreceptor;

an optical unit forming an electrostatic latent image on the photoreceptor;

a development unit visualizing the electrostatic latent image on the photoreceptor with the developing toner to form a visualized toner image;

a transfer unit transferring the visualized toner image onto a recording medium;

a fixing unit fixing the toner image transferred from the transfer unit on the recording medium to obtain a recording image; and a cleaning unit removing a residual toner on the photoreceptor and having a cleaning blade which comes into press contact with the photoreceptor in a low load state, wherein the developing toner satisfies at least one of equations (1) and (2):

$$X \leqq 21 \quad (1)$$

$$X > 21 \text{ and } Y \leqq -0.0329X + 1.6223 \quad (2)$$

wherein X is an absolute value of charge amount of the developing toner (μC/g), wherein Y is a deposition amount of the developing toner ($mg/cm^2$), wherein the carnauba wax and the rice wax are blended in a mixing ratio from 1/10 to 10/1, and wherein the developing toner has a weight average particle size in a range of from 4 μm to 10 μm.

2. The electrophotographic device according to claim 1, wherein the rice wax has an acid value of equal to or less than 13 mg-KOH/g, a melting point of from 78 to 82° C., and a penetration at 25° C. of 5, and wherein the carnauba wax has an acid value of equal to or less than 10 mg-KOH/g, a melting point of from 80 to 86° C., and a penetration at 25° C. of equal to or less than 1.

3. The electrophotographic device according to claim 1, wherein the development unit comprises a plurality of magnetic rolls for development, wherein the plurality of magnetic rolls comprises:

a magnetic roll for forward development which rotates in a forward direction against a traveling direction of the photoreceptor; and a magnetic roll for backward development which rotates in a backward direction against the traveling direction of the photoreceptor, and wherein the magnetic roll for forward development is aligned opposite to the magnetic roll for backward development.

4. The electrophotographic device according to claim 1, wherein the developing toner satisfies equations (1) and (2).

5. The electrophotographic device according to claim 1, wherein the rice wax has an acid value of equal to or less than 13 mg-KOH/g.

6. The electrophotographic device according to claim 1, wherein the rice wax has a melting point of from 78° C. to 82° C.

7. The electrophotographic device according to claim 1, wherein the rice wax has penetration at 25° C. of 5.

8. The electrophotographic device according to claim 1, wherein the carnauba wax has an acid value equal to or less than 10 mg-KOH/g.

9. The electrophotographic device according to claim 1, wherein the carnauba wax has a melting point of from 80° C. to 86° C.

10. The electrophotographic device according to claim 1, wherein the carnauba wax has penetration at 25° C. of equal to or less than 1.

11. The electrophotographic device according to claim 1, wherein the cleaning unit is configured to control an electrostatic absorptivity of the toner and a deposition amount of the toner.

12. The electrophotographic device according to claim 1, wherein the developing unit comprises:

a photosensitive element; and a development roll sleeve; and a development gap set between the photosensitive element and the development roll sleeve, said development gap being approximately 0.5 mm.

13. The electrophotographic device according to claim 1, wherein the blade is configured to contact the photoreceptor in a counter-wise manner against a movement direction of the photoreceptor.

14. The electrophotographic device according to claim 1, wherein the cleaning blade is made of polyurethane.

15. An electrophotographic device, comprising:

a developing toner, comprising a rice wax and a carnauba wax;

a photoreceptor;

an optical unit forming an electrostatic latent image on the photoreceptor;

a development unit visualizing the electrostatic latent image on the photoreceptor with the developing toner to form a visualized toner image;

a transfer unit transferring the visualized toner image onto a recording medium;

a fixing unit fixing the toner image transferred from the transfer unit on the recording medium to obtain a recording image; and a cleaning unit removing a residual toner on the photoreceptor and having a cleaning blade which comes into press contact with the photoreceptor in a low load state, wherein the carnauba wax and the rice wax are blended in a mixing ratio from 1/10 to 10/1, and wherein the developing toner has a weight average particle size in a range of from 4 μm to 10 μm.

16. The electrophotographic device according to claim 15, wherein the developing toner has an absolute value of charge amount that is equal to or less than 21 μC/g.

17. The electrophotographic device according to claim 15, wherein the cleaning blade is made of polyurethane.

18. An electrophotographic device comprising:

a developing toner, comprising a rice wax and a carnauba wax;

a photoreceptor;

an optical unit forming an electrostatic latent image on the photoreceptor;

a development unit visualizing the electrostatic latent image on the photoreceptor with the developing toner to form a visualized toner image;

a transfer unit transferring the visualized toner image onto a recording medium;

a fixing unit fixing the toner image transferred from the transfer unit on the recording medium to obtain a recording image; and a cleaning unit removing a residual toner on the photoreceptor and having a cleaning blade which comes into press contact with the photoreceptor in a low load state, wherein the developing toner has an absolute value of charge amount that is equal to or less than 21 μC/gm, wherein the carnauba wax and the rice wax are blended in a mixing ratio from 1/10 to 10/1, and wherein the developing toner has a weight average particle size in a range of from 4 μm to 10 μm.

19. The electrophotographic device according to claim 18, wherein the cleaning blade is made of polyurethane.

* * * * *